US007086961B2

(12) United States Patent
Wright et al.

(10) Patent No.: US 7,086,961 B2
(45) Date of Patent: Aug. 8, 2006

(54) METHODS AND APPARATUS FOR USING A FREQUENCY-SELECTABLE INSERT IN A GOLF CLUB HEAD

(75) Inventors: David E. Wright, Glendale, AZ (US); Eric V. Cole, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/151,346

(22) Filed: May 20, 2002

(65) Prior Publication Data

US 2003/0216191 A1 Nov. 20, 2003

(51) Int. Cl.
*A63B 53/04* (2006.01)

(52) U.S. Cl. ..... 473/329; 473/340; 473/342

(58) Field of Classification Search ..... 473/329, 473/332, 334, 342, 350, 288, 289, 290, 324, 473/340

See application file for complete search history.

(56) References Cited

U.S. PATENT DOCUMENTS

| | | | | |
|---|---|---|---|---|
| 3,387,844 | A | 6/1968 | Shippee | |
| 4,523,759 | A | 6/1985 | Igarashi | |
| 4,928,965 | A * | 5/1990 | Yamaguchi et al. | 473/332 |
| 5,332,214 | A * | 7/1994 | Tucker, Sr. | 473/329 |
| 5,423,535 | A | 6/1995 | Shaw | |
| 5,551,694 | A | 9/1996 | Grim, Jr. et al. | |
| 5,674,132 | A | 10/1997 | Fisher | |
| 5,695,411 | A | 12/1997 | Wright et al. | |
| 5,728,008 | A * | 3/1998 | Howard | 473/308 |
| 5,746,664 | A | 5/1998 | Reynolds, Jr. | |
| 5,842,935 | A | 12/1998 | Nelson | |
| 6,001,030 | A * | 12/1999 | Delaney | 473/329 |
| 6,030,294 | A * | 2/2000 | Shira | 473/342 |
| D426,599 | S | 6/2000 | Morgon et al. | |
| 6,086,485 | A | 7/2000 | Hamada et al. | |
| 6,095,931 | A | 8/2000 | Hettinger | |
| 6,227,986 | B1 | 5/2001 | Fisher | |
| 6,238,303 | B1 | 5/2001 | Fite | |
| 6,344,000 | B1 | 2/2002 | Hamada et al. | |
| 6,344,001 | B1 | 2/2002 | Hamada et al. | |
| 2003/0083150 | A1 * | 5/2003 | Pond et al. | 473/342 |

FOREIGN PATENT DOCUMENTS

| | | |
|---|---|---|
| WO | WO 01/51135 | 7/2001 |

* cited by examiner

*Primary Examiner*—Glenn Caldarola
*Assistant Examiner*—Tom P. Duong
(74) *Attorney, Agent, or Firm*—Darrell F. Marquette

(57) ABSTRACT

A selectable insert for a golf club head (e.g., for a golf putter) is configured to produce a predetermined frequency response through the use of, for example, a damped single-degree-of-freedom (SDOF) system. A set of such inserts are provided, and one or more inserts from that set is selected in accordance with the response of an individual, for example, an individual's subjective response to the sound of the insert and/or an individual's biomechanical response to the "feel" or discomfort produced by vibrations propagating through the golf club to the individual. In this way, a customized insert may be selected in accordance with, for example: whether and to what extent the individual finds the frequency response of the inset pleasing to the ear; the extent to which the insert produces unpleasant vibrations in the hands, wrists, arms, and other parts of the individual's body; whether the weighting of the club head is suitable; whether the club head is susceptible to unwanted twisting during impact; and/or whether the overall "feel" of the club is subjectively acceptable.

7 Claims, 2 Drawing Sheets

METHODS AND APPARATUS FOR USING A FREQUENCY-SELECTABLE INSERT IN A GOLF CLUB HEAD

BACKGROUND OF THE INVENTION

1. Technical Field

This invention relates, generally, to golf clubs and, in particular, to a golf club head including a frequency-selectable insert.

2. Background Information

An individual golfer's response to the impact between the club head and golf ball during a golf swing is highly individualized, depending not only upon certain biomechanical and kinesthetic characteristics of the golfer, but also upon complex subjective and psychological factors. These and other factors tend to inform a golfer's overall impression of a golf club's performance.

The vibrations produced during impact propagate through the club to the golfer. When a golfer executes a swing as intended, the "feel" of the vibrations tend to promote the golfer's confidence in the club head. In contrast, when the timing and/or form of a swing are not as intended, many golfers experience unpleasant vibrations in the hands, wrist, arms, and other parts of the body, which may reduce the golfer's affinity for the club head. In response, a golfer's body will, in a manner largely beyond the perception of the golfer, tend to compensate for the unpleasant vibrations produced by an imperfect impact by tightening muscle groups or otherwise making subtle musculoskeletal adjustments in an attempt to reproduce a desired vibrational sensation.

In the context of addressing the individualized nature of a golfer's response to club head vibration, prior art golf clubs are unsatisfactory in a number of respects. For example, many prior art club heads are configured to produce a single, predetermined sound irrespective of the preferences of the particular individual actually using the club. U.S. Pat. No. 3,387,844, for example, discloses a golf club head which includes a "percussion chamber plenum" characterized by a single, non-customizable tone apparently intended to provide confirmation of a successful hit. Similarly, U.S. Pat. No. 5,551,694, issued to Grim et al., discloses a golf putter which includes two parallel vibrating tines configured to produce a specific tone during impact.

Prior art club heads which include customizable features have failed to provide a variety of inserts which exhibit a range of frequency response characteristics which may be tailored to a particular golfer. For example, U.S. Pat. No. 5,674,132, issued to Fisher, discloses a putter face insert to yield the desired "rebound factor" which, secondarily, has a certain "feel" during impact. U.S. Pat. No. 6,238,303, issued to Fite, discloses a golf putter with adjustable characteristics, including texture and "feel"; these characteristics do not include, however, a predetermined frequency response. U.S. Pat. No. 5,746,664, issued to Reynolds, discloses a golf putter head with removable weights asserted to affect the club's "feel". U.S. Pat. No. 6,094,931, issued to Hettinger et al., discloses an isolation layer between the club head body and a weight body (each of which is fabricated from a different material) such that the "feel and playability" of the club head is the same as a club head fabricated from a single material.

BRIEF SUMMARY OF THE INVENTION

The present invention provides a selectable insert for a club head (e.g., for a golf putter) configured to produce a selectable, predetermined frequency response through the use of, for example, a damped single-degree-of-freedom (SDOF) system. A set of such inserts are provided such that one or more inserts from that set may be selected to accommodate a given golfer's subjective response to the sound of the insert and/or an individual's biomechanical response to the "feel" (e.g., discomfort) produced by vibrations propagating through the club to the golfer's body.

In this way, a customized insert may be selected in accordance with, for example: whether and to what extent the individual finds the frequency response of the inset pleasing to the ear; the extent to which the insert produces unpleasant vibrations in the hands, wrists, arms, and other parts of the individual's body; whether the weighting of the club head is suitable; whether the club head is susceptible to unwanted twisting during impact; and/or the degree to which the overall "feel" of the club is subjectively acceptable.

BRIEF DESCRIPTION OF THE DRAWINGS

The subject invention will hereinafter be described in conjunction with the appended drawing figures, wherein like numerals denote like elements, and.

DETAILED DESCRIPTION

The present invention provides a club head insert configured to produce a desired frequency response through the use of, for example, a damped single-degree-of-freedom (SDOF) system. The present invention also provides a series of such inserts, each exhibiting a different value within a range of mechanical characteristics. One or more inserts may be selected from that set in accordance with the response of an individual, for example, an individual's subjective response to the sound of the insert and/or to produce a desired biomechanical response to the "feel" produced by vibrations propagating through the club to the body of the individual.

Figure 1:
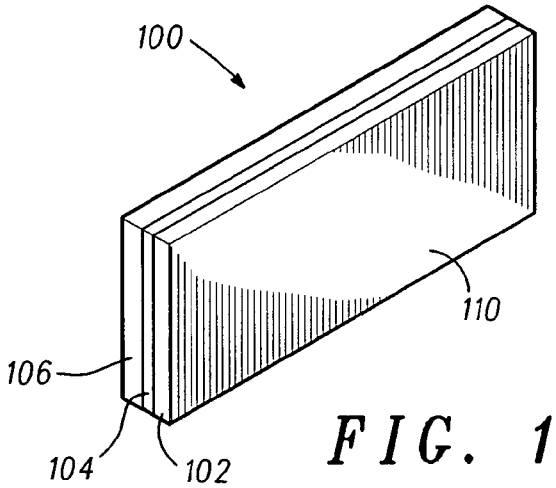
FIG. 1 is an isometric overview of an insert in accordance with one embodiment of the present invention.

Referring now to FIG. 1, a club head insert, or simply "insert" 100, generally includes a plate 102 mechanically coupled to a mass 106 via a damper 104, wherein plate 102 has a striking surface 110 which, as described further below, is configured to be substantially co-planar with the face of the club head. For simplicity, the geometry of the various components of insert 100 (i.e., mass 106, damper 104, and plate 102) are illustrated in FIG. 1 as rectilinear layers. The present invention is not so limited, however, in that any suitable shape may be employed for each of these components.

As described in further detail below, the mechanical behavior of insert 100 may be modeled as a damped single-degree-of-freedom (SDOF) system which exhibits a particular frequency response during impact, i.e., when the club head (and consequently surface 110 of plate 102) strikes a golf ball (not shown). This frequency response, and if desired other relevant characteristics of the insert, may be specified a priori by proper selection of plate 102, damper 104, and mass 106. Recognizing that different golfers have different biomechanical and/or subjective responses to the sound and "feel" of a club head striking a ball, the present invention provides an array of inserts, each having a predetermined set of mechanical characteristics (e.g., weight, moment of inertia, frequency response), which can be selectively and removeably integrated into a club head and tested by an individual until a suitable insert is found.

Having thus given an overview of the present invention and the manner in which it may be used, aspects of its various components will now be described in detail, along with a brief derivation of the principles involved in selecting the various components of the insert.

With continued reference to FIG. 1, mass 106 is a structure of suitable shape and composition such that, constrained by damper 104 (and otherwise substantially unconstrained), mass 106 is configured to produce a predetermined frequency response when striking surface 110 is subjected to impact with a golf ball. More particularly, the spatial excursion of mass 106 with respect to plate 102 along an axis normal to plate 102 exhibits a predetermined frequency response.

Mass 106 may comprise any suitable metal, plastic, and/or composite material. Acceptable materials include, for example, titanium, copper, steel (e.g., stainless steel), bronze, and the like. In the event mass 106 comprises a metal such as steel or titanium, mass 106 may be formed through any convenient method, for example, via conventional casting and/or milling processes. Plate 102 of insert 100 may comprise any suitable material (e.g., one or more metals, composites, and/or plastics).

Figure 2:
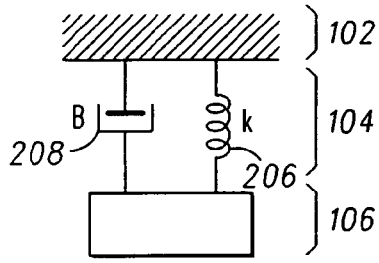
FIG. 2 is a schematic diagram illustrating a single-degree-of-freedom mechanical system corresponding to the insert of FIG. 1.

Referring now to FIGS. 1 and 2, the behavior of mass 106 with respect to clubface plate 102 and damper 104 may be modeled as free vibration of a viscously-damped SDOF system. As modeled in FIG. 2, mass 106 (m) is coupled to a plate 102 (which acts as the reference in this model) by damper 104, which is modeled as a viscous damper 208 (having a damping constant B) in parallel with a spring 206 (having a stiffness k). Thus, while damper 104 exhibits characteristics of both a viscous damper and a spring, the term "damper" is used herein for simplicity.

A damped, SDOF system such as that shown in FIG. 2 oscillates at a damped natural frequency (or "modal frequency"), which may be characterized as:

$$\omega_d=\sqrt{1-\zeta^2\omega_n} \qquad \text{equation (1)}$$

where $\zeta$ is the damping ratio of the system, and $\omega_n$ is the undamped natural frequency expressed in terms of stiffness k and mass m:

$$\omega_n = \sqrt{\frac{k}{m}} \qquad \text{equation (2)}$$

For a severely underdamped SDOF system (i.e., wherein $\zeta \cong 0$), the damping constant of viscous damper 208 drops out of the above equation (1) for $\omega_d$, and the modal frequency reduces to a function of only k and m. That is, the damped vibration frequency f is equal to the natural frequency which, in terms of cycles per second, is given by:

$$f = \frac{1}{2\pi}\sqrt{\frac{k}{m}} \qquad \text{equation (3)}$$

The foregoing equation (3) provides a guideline for producing an insert 100 having a frequency-response centered on a single predetermined frequency f. For example, if a 90 Hz natural frequency is desired, the stiffness k of damper 104 and the mass m of mass 106 are selected such that the ratio $k/m=(2\pi f)2=(\pi(90))^2=3.2E5$. To further develop this example, consider a titanium mass 106 having dimensions of 2.5×5.0×0.5 cm and a density of 4510 kg/m$^3$. In this case, m is equal to approximately 28 grams; in accordance with this aspect of the invention, a damper 104 may thus be selected with a stiffness k of about (0.028)×(3.2E5), or about 9020 N/m.

Interposed between mass 106 and plate 102, damper 104 provides viscoelastic damping of vibration produced during impact, thus controlling to a large extent the predetermined frequency response of insert 100. Damper 104 may include, for example, a sheet of damping material such as a foam, acrylic sheet, or polyurethane, or a suitable filled vinyl copolymer or laminate (e.g., one or more layers of foil and polymer).

The stiffness k of damper 104 may be specified through testing of various materials and thicknesses through any conventional technique. For example, a durometer may be configured to measure the penetration distance of an indentor into a specimen, thus producing a numeric value representative of the specimen's hardness. While durometers are primarily used to test the hardness of non-metallic materials, they may also be used to indirectly measure such properties as tensile modulus, resiliency, and stiffness—all of which can be reasonably correlated to hardness in many materials. Durometers (including the widely-used type 'A' and type 'D' durometers) typically conform to the American Society for Testing and Material specification ASTM D2240, which is hereby incorporated by reference.

Mass 106 may be attached to damper 104 and plate 102 using any convenient method, including, for example, the use of industrial epoxies or other adhesives at the interfaces of the components, or the use of a damping material having a pressure sensitive adhesive on one or more of its surfaces.

Figure 3:
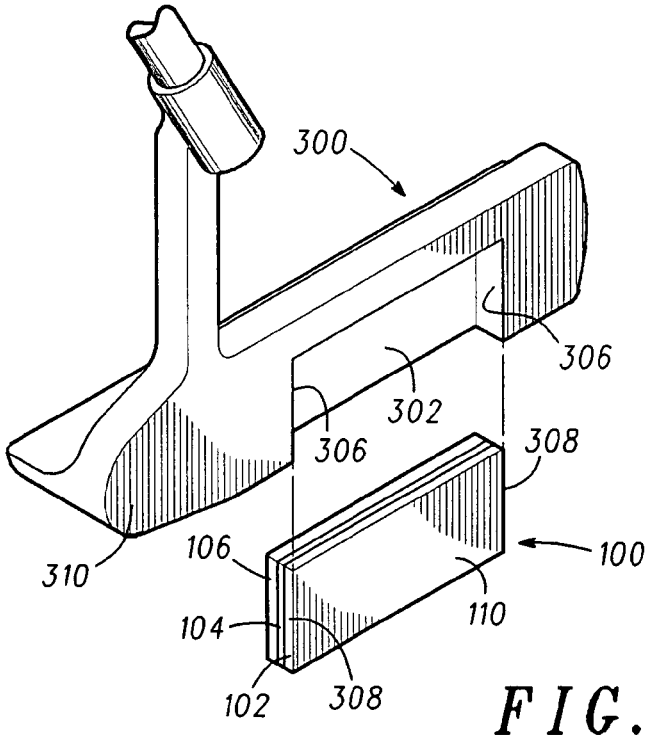
FIG. 3 is an isometric overview of an insert and club head in accordance with one embodiment of the present invention.

Referring now to FIG. 3, in a preferred embodiment of the present invention, insert 100 is configured to be attached to a golf club head (or simply "club head") 300 such that surface 110 of plate 102 is substantially coplanar with a front face 310 of club head 300. Plate 110 may comprise a material which is the same as or different from the material used for club head 300. Similarly, surface 10 of insert 100 may be textured (i.e., ribbed, abraded, etc.) to match or, alternatively, to contrast with that of face 310.

In the illustrated embodiment, club head 300 includes a cavity 302 configured to accept insert 100, for example by sliding into the club head 300 from the bottom such that one or more inner surfaces 306 of club head 300 mate with corresponding surfaces 308 at the periphery of insert 100. As described briefly above, it is preferred that the damper 104 and mass 106 are substantially unconstrained, i.e., not mechanically coupled directly to the club head 300 itself. As such, cavity 302 may be slightly larger than the mechanical dimensions of damper 104 and mass 106 such that they do not contact the inner edges 306 and/or other inner surfaces of cavity 302.

As discussed in further detail below, the present invention provides a method for removeably attaching insert 100 to club head 300 in accordance with an iterative testing procedure. Insert 100 may then be "permanently" affixed to the club head 300 after a suitable insert is determined. In this regard, insert 100 and cavity 302 may be configured to mate in accordance with any convenient technique, including, for example, the use of compression fits, rabbit, wedge, dovetail, or tongue-in-groove joints, either with or without the use of an adhesive (e.g., any of the varieties of industrial epoxies). Those skilled in the art will appreciate that a suitable adhesive may be selected which is chemically and/or mechanically compatible with the material or materials used for insert 100 and club head 300, and further in view of various environmental (e.g., thermal, physical) factors relating to the intended use of the club head 300. It will be understood that in the finished golf club (e.g., golf putter) club head 300 is suitably attached to an appropriate shaft 301 having a grip disposed thereon.

Figure 4:
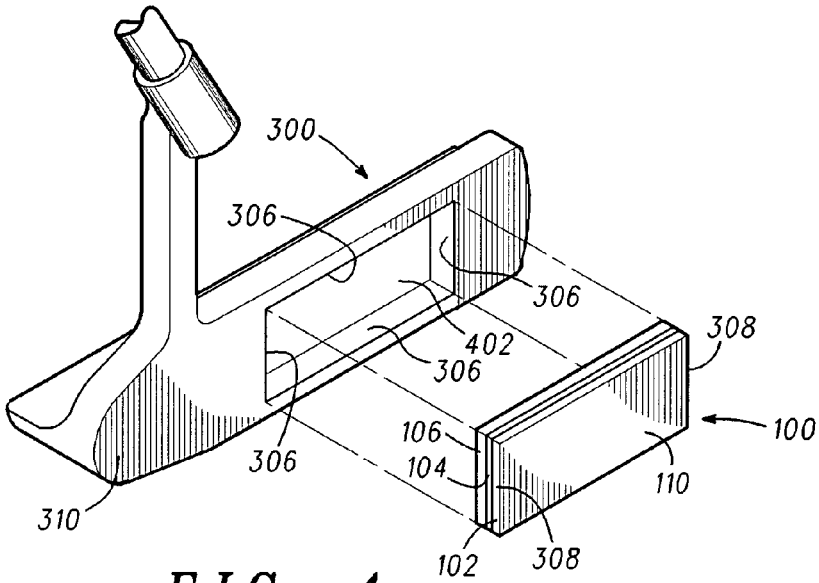
FIG. 4 is an isometric overview of an insert and club head in accordance with an alternate embodiment of the present invention.

Referring now to FIG. 4, in an alternate embodiment of the present invention, a cavity 402 may be formed in club head 300, for example, extending from face 310. Rather than sliding into club head 300 through the bottom or sole of the club head (as shown in FIG. 3), in the embodiment shown in FIG. 4 insert 100 loads directly from the front and is suitably attached such that one or more surfaces (e.g., the periphery) of plate 102 may be attached to one or more inner surfaces 306 of club head 300. One or more of these mating surfaces may also incorporate a shoulder, bevel, chamfer, draw, or a combination thereof.

The embodiments shown in FIGS. 3 and 4 are non-limiting examples of the range of possible methods of attaching insert 100 to club head 300. Alternate configurations, e.g., configurations in which insert 100 is inserted through a cut-out in the bottom of club head 300 and then pushed forward into place (rather than slid into place from the bottom) are also comprehended by the present invention.

Figure 5:
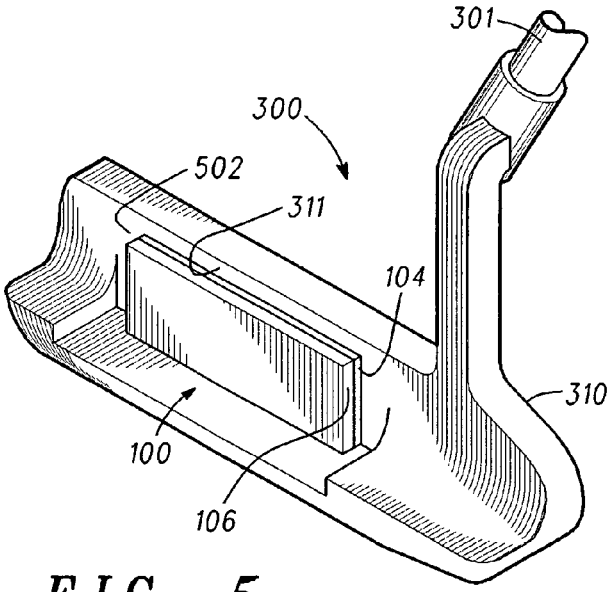
FIG. 5 is an isometric overview of a further embodiment of the present invention.

Similarly, referring now to FIG. 5, another embodiment of the present invention involves the use of an insert 100 which includes a damper 104 and mass 106, shown attached to a back 502 of club head 300, for example, a back surface 311 opposite front face 310. In this embodiment, a feature of the club head itself (e.g., the thickness of club head 300 measured between front face 310 and back surface 311) may function as the "reference" (analogous to plate 102) for purposes of the mechanical model shown in FIG. 2. In this way, the need for discrete plate 102 may be mitigated or even eliminated. The mass 106 and damper 104 may be selected in accordance with substantially the same principles described above in connection with FIG. 1.

Figure 6:
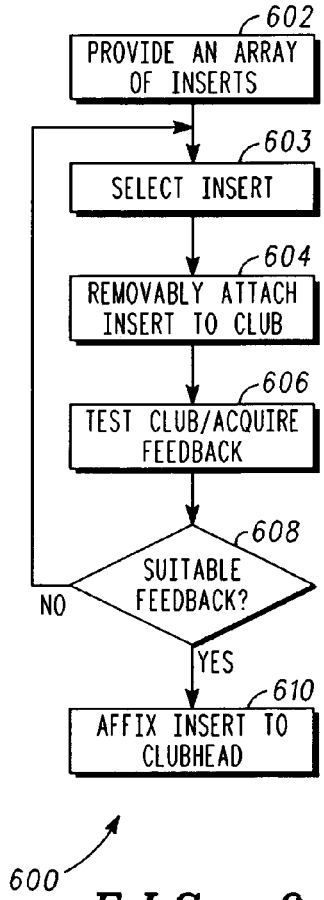
FIG. 6 is a flowchart showing an exemplary method in accordance with the present invention.

Referring now to FIG. 6, a method 600 for tuning (customizing) an insert 100 for an individual golfer in accordance with the present invention will now be described. It should be understood that the exemplary process illustrated in FIG. 6 is non-limiting, and that this aspect of the invention may include more or less steps or may be performed in the context of a larger processing scheme. Furthermore, the flowchart presented FIG. 6 is not to be construed as limiting the order or sequence in which the various process steps may be performed.

Initially, in step 602, an array of inserts 100 are provided which have a predetermined set of characteristics designed to probe various indicia of an individual's biomechanical response to club head impact. The term "array" as used herein refers to a one-dimensional, two-dimension, or, more generally, an n-dimensional array of inserts (or discrete components which may comprise an insert), each exhibiting different values of n characteristics (e.g., mass, frequency response, size, shape, and the like). That is, it may be desirable to pre-select a single-dimensional array of inserts 100 of comparable weights having a variety of frequency responses. Alternatively, it may be desirable to construct a two-dimensional (or n-dimensional) array of inserts having various weights as well as various frequency responses. In this way, the individual golfer's response to multiple insert characteristics may be tested.

As described above, the frequency response characteristic of the insert 100 is important in providing a club head which sounds and "feels" suitable to an individual golfer. In this regard, an array of inserts having different frequency responses may comprise a series of inserts having progressively higher dominant resonant frequencies in accordance with any desired scale, for example, a linear scale (e.g., 80 Hz, 100 Hz, 110 Hz, etc.) or a non-linear scale (e.g., 10 Hz., 100 Hz, etc.). The range and granularity of frequency values may be selected in accordance with, for example, the type of club being tested (e.g., putter or iron) and/or the particular biomechanical response being tested (e.g., sound, vibration in hands, shoulder pain, etc.). The present invention is not limited to inserts exhibiting a single resonant frequency. Indeed, any predetermined frequency response (for example, bimodal, or otherwise shaped to a particular transfer function) may be used as a characteristic.

During a paradigmatic fitting (customization) session, an insert 100 is selected or constructed from the array of available inserts or insert components (step 603), and removeably attached to the club head (step 604). The phrase "removeably attached" as used in connection with this step is intended to cover the range of methods for securing the insert 100 to the club head such that the attachment is sufficiently secure to assess the golfer's reaction to vibrations during testing, while at the same time facilitating convenient removal for further testing of additional inserts. In this regard, various methods of securing the insert to the club head may be employed, including the use of adhesives and/or compression fit as described above.

In step 606 the individual golfer tests the club head, and suitable feedback from the individual is acquired. For example, the individual may swing the club and strike a test object (e.g., an actual or simulated golf ball) one or more times under conditions which reasonably approximate normal play conditions. Feedback may include subjective feedback from the individual (including, for example, the individual's opinion regarding sound, feel, pain, and the like) and/or objective feedback in the form of, for example, clinical measurements (actual or inferential) of the individual's body and kinesthetic behavior during a swing. Indicia of the individual's biomechanical response may include, for example: (a) whether and to what extent the individual finds the frequency response of the inset pleasing to the ear; (b) the extent to which the insert produces unpleasant vibrations in the hands, wrists, arms, and other parts of the individual's body; (c) whether the weighting of the club head is suitable; (d) whether the club head is susceptible to unwanted twisting during impact; and/or (e) whether the overall "feel" of the club is acceptable.

In step 608, the golfer's response to the vibrations produced during impact with the then-current insert is evaluated. If the feedback suggests that the golfer has not yet achieved a sufficiently desirable response ("no" branch from step 608), another insert is selected (step 603), and testing continues as described above. If the then-current insert produces an optimal response ("yes" branch from step 608), that insert is selected and the process proceeds to step 610. Alternatively, step 608 may require successive looping back to step 603 until all available inserts within a particular array (or one characteristic of the array) are tested. The optimal insert may then be selected even if it is not the then-current insert, and processing can continue with step 610.

In an alternate embodiment, a single insert is selected from the array in accordance with a predetermined criterion resulting, for example, from an individual's susceptibility to certain frequencies of vibration. For example, a golfer's body may be subjected to physical testing (e.g., through appropriate probes, sensors, etc.) to determine how certain vibrations propagate through the golfer's body. The resulting data may then be used to determine an appropriate insert design. In such a case, no iterative procedure may be necessary.

The testing process depicted in steps 603-608 may be performed in accordance with standard test techniques used, for example, in the field of experimental psychology (e.g., double-blind trials and the like).

After testing is complete, the selected insert is permanently affixed to the club head. In this context, the phrase "permanently affixed" means that the insert may be secured to the club head such that it remains substantially in place during normal (or even stressed) playing conditions, but does not necessarily mean that the insert can never be removed from the club head. Indeed, it may be desirable for an individual to "re-tune" his or her golf club in response to, for example, a golfer's changing physical condition, ability, or the like. In such a case, the insert may later be removed for further testing.

Fixing the insert to the club head for the purposes of step 610 may include the use of a one or more adhesives, welds, solders, rivets, fasteners, and the like. In accordance with another embodiment of the present invention, a relatively compliant polymeric compound may be used to integrate the insert with the club head such that the insert is further mechanically decoupled from the club head. That is, the adhesive itself may also function to a degree as a mechanical component of the system with its own stiffness and damping attributes.

In accordance with another aspect of the present invention, the insert may include visible indicia corresponding to one or more characteristics of the insert. For example, the insert may be color-coded or include one or more symbols or text which, if desired, may be positioned so that they are visible when viewing the club head, for example, during play or when the club is in a golf bag. In accordance with another aspect of the present invention, a suitable plate or layer (e.g., any suitable plastic, metal, or composite) may secured to face 310 of club head 300.

Although the invention has been described herein in conjunction with the appended drawings, those skilled in the art will appreciate that the scope of the invention is not so limited. Modifications in the selection, design, and arrangement of the various components and steps discussed herein may be made without departing from the scope of the invention as set forth in the appended claims.

What is claimed is:

1. A golf club head comprising:

a putter club head body having a cavity formed therein, said cavity being defined by a pair of inner surfaces of said club head body;

an insert comprising a plate mechanically coupled to a mass via a damper, wherein said plate has a striking surface and a pair of edge surfaces in mating engagement with said pair of inner surfaces of said club head body, wherein said mass is substantially unconstrained by said club head body, and wherein said insert is removeably integrated with said club head body and positioned within said cavity such that said striking surface of said plate is substantially coplanar with and rigidly coupled to a front face of said club head body;

said mass and said damper are configured to produce a predetermined frequency response when said striking surface impacts an object: and said cavity having a width dimension greater than a width dimension of said mass and said damper such that said mass and said damper have no contact with said pair of inner surfaces.

2. The golf club head of claim 1, wherein said mass and said damper are configured in accordance with a single-degree-of-freedom system, and wherein said predetermined frequency response consists of a frequency response centered around a single frequency.

3. The golf club head of claim 2, wherein said frequency response is centered around a damped natural frequency, $\omega_d$, given by:

$$\omega_d = \sqrt{1-\varsigma^2}\,\omega_n,$$

where $\zeta$ is the damping ratio, and $\omega_n$ is the undamped natural frequency of said insert in terms of a stiffness k of said damper and mass m of said mass, and wherein:

$$\omega_n = \sqrt{\frac{k}{m}}.$$

4. The golf club head of claim 3, wherein $\zeta$ is approximately zero, and wherein said frequency response is centered around a single frequency corresponding to the undamped natural frequency of said insert.

5. The golf club head of claim 2, wherein said plate of said insert slides into said cavity of said club head body.

6. The golf club head of claim 2, wherein said plate comprises a material selected from the group consisting of bronze, steel, copper, and titanium.

7. The golf club head of claim 2, wherein said plate comprises a polymeric material.

* * * * *